US005775064A

United States Patent [19]

Iwata

[11] Patent Number: 5,775,064

[45] Date of Patent: Jul. 7, 1998

[54] CARTONING MACHINE

[75] Inventor: Yasuo Iwata, Tokyo, Japan

[73] Assignee: Tokyo Automatic Machinery Works, Ltd.

[21] Appl. No.: 683,982

[22] Filed: Jul. 22, 1996

[51] Int. Cl.[6] ..... B65B 11/12

[52] U.S. Cl. ..... 53/466; 53/233

[58] Field of Search ..... 53/466, 461, 462, 53/207, 228, 233, 232, 231, 230

[56] References Cited

U.S. PATENT DOCUMENTS

| | | | |
|---|---|---|---|
| 1,481,207 | 1/1924 | Johnson | 53/233 X |
| 2,486,892 | 11/1949 | Sumida | 53/233 |
| 2,991,604 | 7/1961 | Liedtke | 53/233 |
| 3,220,160 | 11/1965 | Roberts | 53/233 |
| 3,513,630 | 5/1970 | Lattke et al. | 53/233 X |
| 4,983,154 | 1/1991 | Nagahashi et al. | 493/315 |

FOREIGN PATENT DOCUMENTS

| | | |
|---|---|---|
| 0555852 | 8/1993 | European Pat. Off. . |
| 3-98810 | 4/1991 | Japan . |
| 1167170 | 10/1969 | United Kingdom . |
| 2233954 | 1/1991 | United Kingdom . |

OTHER PUBLICATIONS

A Foreign Patent Office Communication. (Nov., 1996).
An English Language Abstract (Apr. 24, 1991).

*Primary Examiner*—James F. Coan
*Attorney, Agent, or Firm*—Greenblum & Bernstein P.L.C.

[57] ABSTRACT

The present invention relates to a cartoning machine in which box-like (i.e., generally rectangular) contents with a carton positioned therearound are fed, and when the box-like contents with the carton have passed a pivotable face of a conveyance pocket positioned on the most upstream side in the conveyance direction, a fold-down piece operates to fold down an upper body flap of the carton. After this operation, the pivotable face is raised from a lower position to fold up a lower body flap, whereby the lower body flap is overlapped on the outside of the upper body flap to complete the body folding of the carton. Thereafter, a plurality of conveyance pockets are conveyed simultaneously by intermittent operation of endless flexible members, whereby side flaps of each carton, which has gone through the body flap folding operation, are folded in successively to complete the cartoning.

14 Claims, 4 Drawing Sheets

"PRIOR ART"

CARTONING MACHINE

TECHNICAL FIELD OF THE INVENTION

The present invention relates to a cart-oning machine for packing box-like contents comprising arranged and stacked packages of, say, cigarettes into a carton and more particularly to a cartoning machine wherein arranged and stacked box-like contents are fed horizontally and are brought into abutment with a flat carton before folding which carton has been fed in a direction approximately orthogonal to the feed direction of the box-like contents, thereby allowing the carbon to be wound in U shape around the box-like contents, then body flaps and side flaps of the carbon are folded inside while the box-like contents and the carton are conveyed nearly horizontally, thereby allowing the box-like contents as arranged and stacked to be packed into the thus-folded carton.

BACKGROUND ART

According to a conventional cartoning machine of this type, as shown in FIG. 4, box-like contents B with a carton A wound in U shape therearound are fed onto a horizontal conveyance path 10, then both upper and lower body flaps A1, A2 are folded inside successively, and succeeding carton A and box-like contents B are brought into abutment with the body flap-folded carbon A and the box-like contents B therein, whereby both are conveyed in a mutually abutted, or pressed state, intermittently and in this state side flaps A3 of the carbon A are folded inside successively to complete cartoning.

According to such a conventional cartoning machine, however, cartons and box-like contents are conveyed in an intermittent and pressed state on the horizontal conveyance path, so when the cartoning (or job) is over, there remain on the conveyance path cartons whose body flaps and side flaps have not completely been folded yet and cartons which have gone through the cartoning work completely. Therefore, after the end of the cartoning work or at the time of cleaning it is necessary to remove the residual cartons from the conveyance path, but this removing work is troublesome.

In view of the above problem, for example as disclosed in Japanese Patent Laid-Open No. Hei 3-98810, there has been proposed a cartoning machine wherein box-like contents with a carton wound in U shape therearound are fed into a pocket of a turret, then body flaps of the carton are folded inside successively, the carton and the box-like contents therein are then conveyed by a subsequent intermittent rotation of the turret, and thereafter side flaps of the carton are folded inside successively to complete cartoning.

According to this conventional cartoning machine, however, when the arranged and stacked packages change in size with consequent change in external dimensions of the box-like contents, it is necessary to change each pocket of the turret accordingly or replace the whole of the turret with another one. Thus, the adjusting work with change in size of the box-like contents is troublesome and takes time.

DISCLOSURE OF THE INVENTION

Accordingly, it is the first object of the present invention to deliver each carton as a finished product to the subsequent step without residual cartons not yet folded at the end of the cartoning work.

It is the second object of the present invention to easily cope with a change in size of box-like contents without the use of any replacement part.

In order to achieve the first object mentioned above, the present invention is characterized by a plurality of conveyance pockets arranged in the conveyance direction of the box-like contents for engagement with the fed carton and box-like contents to convey them in the same direction as the conveyance direction. Endless flexible members are provided with the plural conveyance pockets at predetermined intervals, a drive source is connected to the endless flexible members to move them intermittently, and one pivotable face is supported pivotably in each of the plural conveyance pockets and is adapted to come into opposition to and abutment with a lower body flap of the carton and a rear face in the feed direction of the box-like contents. A system is provided for pushing down and holding the one pivotable face of the conveyance pocket, which is positioned at the most upstream side in the conveyance direction, in the direction opposite to the feed direction so as to become almost flush with the inner bottom surface of the conveyance pocket until the fed carton and box-like contents transfer into the conveyance pocket. A fold-down piece is provided for folding down an upper body flap of the carton along the rear face of the box-like contents when the fed carton and box-like contents have passed into the conveyance pocket standing by on the most upstream side in the conveyance direction. A raising system pivotally raising the one pivotable face after the operation of the fold-down piece, a raised state holding system holds the raised state of the one pivotable face, and a fold-in piece successively folds in the side flaps of the cartons being conveyed simultaneously in the plural conveyance pockets by the operation of the endless flexible members.

According to the above construction, when box-like contents with a carton wound in U shape therearound have been fed and passed over the pivotable face of the conveyance pocket which is standing by on the most upstream side in the conveyance direction, the fold-down piece is operated to fold down the upper body flap of the carton, thereafter the pivotable face is raised from its pushed-down state to fold up the lower body flap of the carton, whereby the lower body flap is overlapped on the outside of the upper body flap to complete the body flap folding operation, and subsequently plural conveyance pockets are moved simultaneously by intermittent operation of the endless flexible member, so that the side flaps of each carton after the end of the body flap folding are folded inside successively by the fold-in piece to complete the cartoning work.

Thus, each carton can be delivered as a finished product to the subsequent step without any residual carton not folded yet at the end of the work. Consequently, in comparison with the conventional cartoning machine wherein cartons and box-like contents are conveyed in an intermittent and pressed state on a horizontal conveyance path, there remains at the end of the cartoning work neither a carton whose body flaps and side flaps have not been completely folded yet nor a completed carton, with the result that the clear-up work and cleaning work after the end of the operation can be done easily.

In order to achieve the second object of the present invention mentioned above it is desirable to provide an adjusting means which supports one face of the plural conveyance pockets opposed to either the front face or rear face side of the carton and box-like contents so as to be movable for adjustment relative to the other faces and which makes the adjustment for all of the conveyance pockets at one time.

According to this construction, when the external dimensions of the box-like contents change with a change in size of the packages arranged and stacked, the spacing between both faces of each conveyance pocket opposed respectively to the front and rear sides in the conveyance direction of the carton and box-like contents present in the pocket is adjusted by the adjusting means and this adjustment is made simultaneously for all of the conveyance pockets.

Thus, the change in size of the box-like contents can be coped with easily without the use of any replacement part. Accordingly, in comparison with the conventional construction which requires replacement of each turret pocket or replacement of the entire turret at every change in external dimensions of the box-like contents with change in size of the packages arranged and stacked, the adjusting work to cope with such change in size of the box-like contents is simple and does not require much time.

DESCRIPTION OF EMBODIMENT

An embodiment of the present invention will be described herein under with reference to the accompanying drawings.

Figure 1:
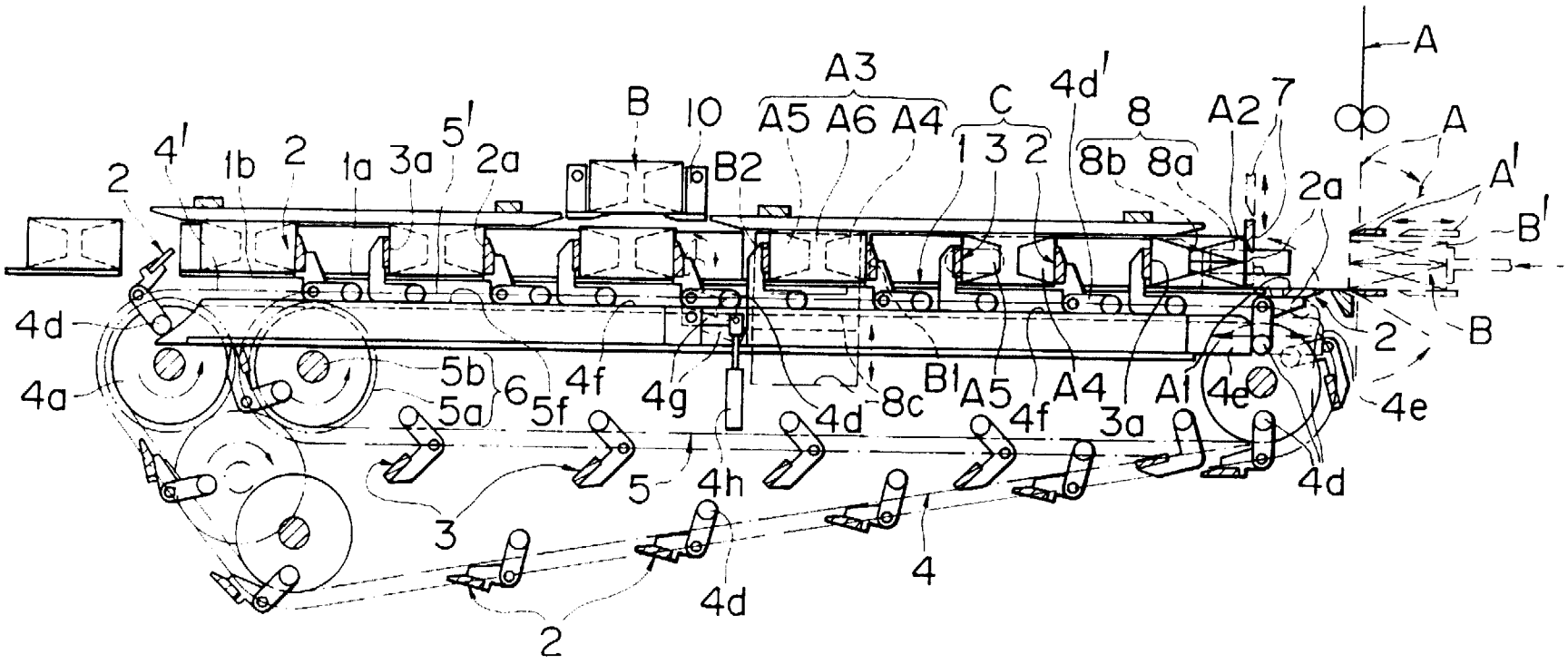
FIG. 1 is a front view in longitudinal section of a cartoning machine according to an embodiment of the present invention.

According to this embodiment, as shown in FIG. 1, a flat carton A before folding is fed up to a predetermined position by the operation of a carton feed mechanism such as feed rollers for example, and just thereafter a framing piece A adapted to operate intermittently by means of a cam for example is brought into abutment with the flat carton A, whereby the body portion of the carton is folded in a generally U shape along folding lines of the carton. Subsequently, box-like contents B of arranged and stacked packages are pushed against the generally U-folded carton A by means of a pusher B' which reciprocates intermittently in the horizontal direction through a cam for example, thereby allowing the carton A to be wound in U shape around the box-like contents B while preventing damage of the corner portions of the carton, and allowing the carbon with the box-like contents to be fed into a conveyance pocket C which is standing by on the most upstream side in the conveyance direction.

The conveyance pocket C comprises a conveyance path 1 located on an extension of the feed direction of the box-like contents B pushed by the pusher B , the conveyance path 1 constituting an inner bottom surface of the pocket C and on which carton A and boxlike contents B are positioned so as to be conveyable in the same direction as the feed direction, a pivotable pusher plate 2 capable of coming into abutment with a lower body flap A1 of the carton A and a rear face B1 side in the feed direction of the box-like contents B, and a pivotable holding plate 3 capable of coming into abutment with the carton A and a front face B2 side in the feed direction of the box-like contents B to hold the two between it and the pusher plate 2.

Under the conveyance path 1 are horizontally disposed endless flexible members 4 and 5 as separate members extending along the said conveyance path and each constructed of, for example, a timing belt or a chain. Driving wheels 4*a* and 5*a* for the endless flexible members 4 and 5 are connected to the same drive source as that for the framing piece A' or the pusher B' or to a drive source adapted to operate intermittently in synchronism with the said drive source, whereby after the end of operation of fold-in tuckers 7*a*, 7*a* which will be described later, upper horizontal portions 4' and 5' extending along the conveyance path 1 of both endless flexible members 4 and 5 are moved at the same speed and in the same direction as the feed direction of the box-like contents B pushed by the pusher B', and this movement of both endless flexible members 4 and 5 is terminated by the time when the succeeding box-like contents B are brought into abutment by the pusher B' with a carton A whose body portion has been folded in a generally U shape by the framing piece A'.

The pusher plate 2 of the conveyance pocket C is mounted to one endless flexible member 4 in a plural number and at predetermined intervals, while the holding plate 3 of the pocket C is mounted to the other endless flexible member 5 also in a plural number and at predetermined intervals, in such a manner that the spacing between adjacent and opposed pusher plate 2 and holding plate 3 is approximately equal to the width in the feed direction of the box-like contents B. Further, the pusher plate 2 disposed on the most upstream side in the conveyance direction is allowed to stand by at an upstream end in the conveyance direction of the conveyance path 1 when the drive source stops operation intermittently.

The endless flexible member 4 or 5 is provided with an adjusting mechanism 6 for adjusting and moving one of the endless flexible member 4 with the pusher plates 2 mounted thereto and the endless flexible member 5 with the holding plates 3 mounted thereto with respect to the other.

In this embodiment, the adjusting mechanism 6 temporarily releases the connection between the driving wheel 5*a* and a driving wheel 5*b* both having the endless flexible member 5 with the holding plates 3 mounted thereto, and then only the endless flexible member 5 and holding plates 3 are adjusted and moved by a manual operation for example, to change the spacing between adjacent and opposed pusher plate 2 and holding plate 3 into a spacing almost equal to the width in the feed direction of box-like contents B after the change of size. In this case, irrespective of the change in size of the box-like contents B, the holding plate 3 located on the most upstream side in the conveyance direction is made to stand by in the position where it comes into abutment with the front face B2 in the feed direction of the box-like contents B fed by the pusher B'.

Figure 2:
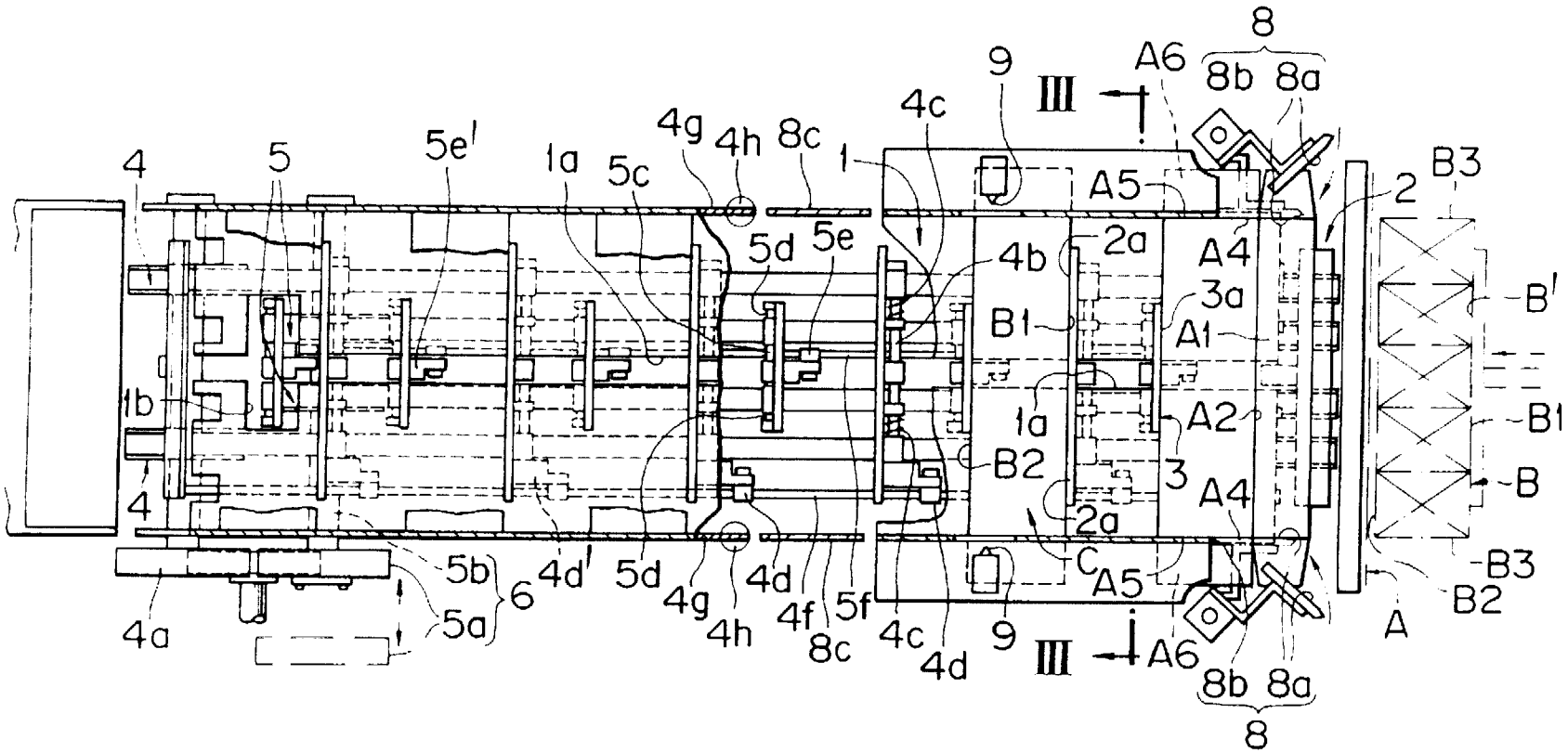
FIG. 2 is a plan view in transverse section thereof.
Figure 3:
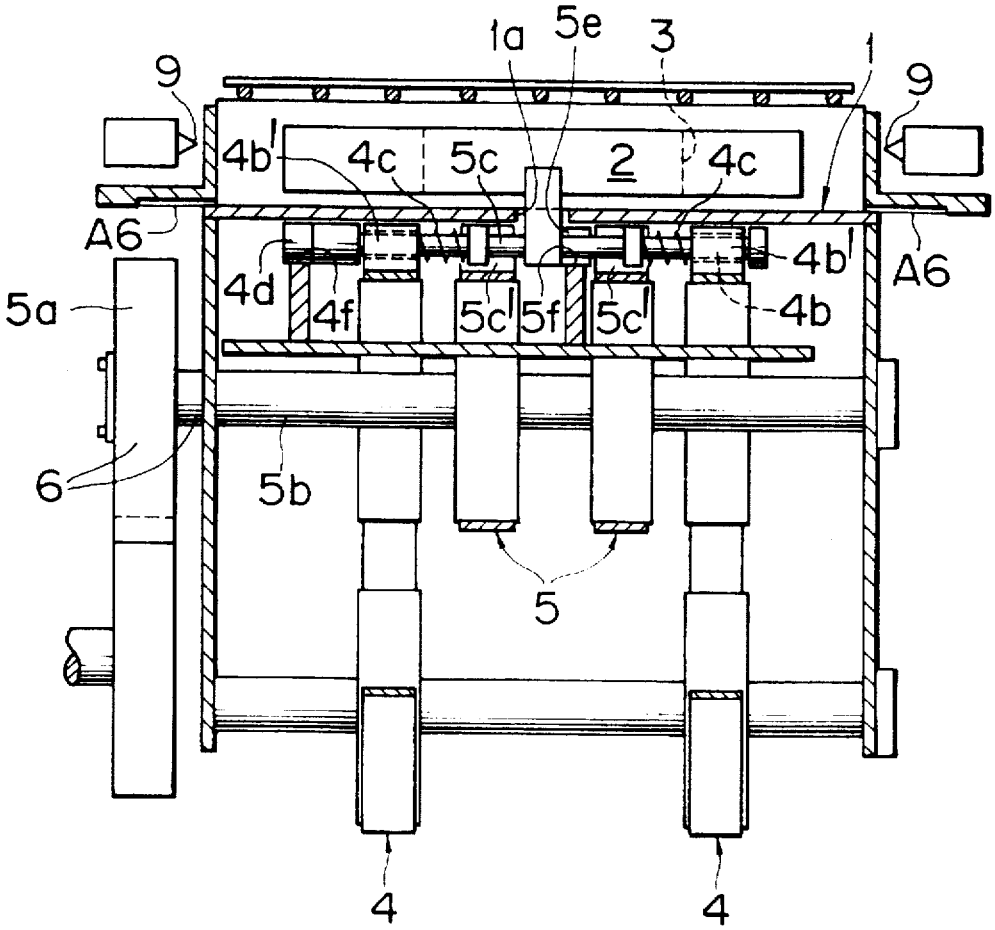
FIG. 3 is a partial enlarged side view in vertical section taken along line (III)—(III) in FIG. 2, showing principal portions in a partially cut-away fashion.
Figure 4:
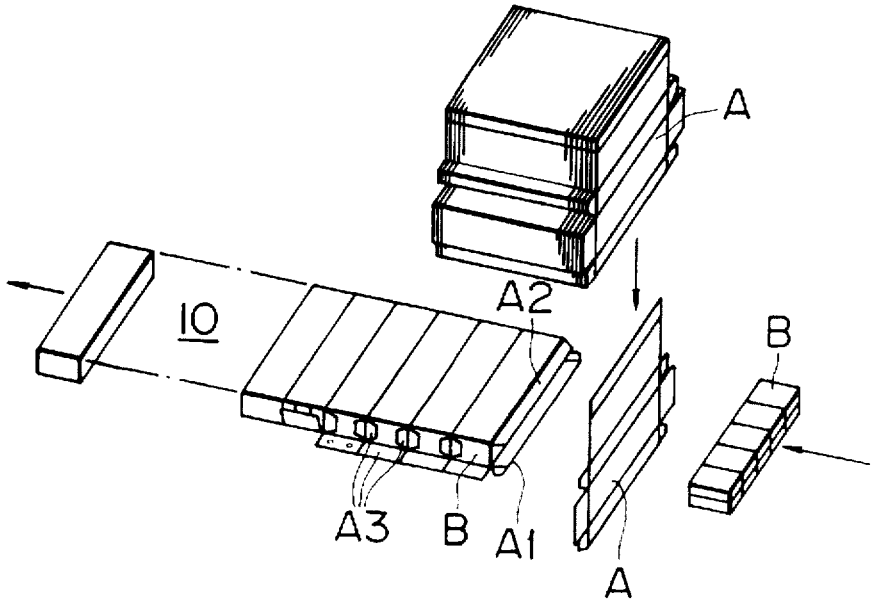
FIG. 4 is a perspective view showing an example of a conventional cartoning machine.

In this embodiment, as shown in FIGS. 2 and 3, the endless flexible members 4 and 5 are disposed each in a pair in the transverse direction orthogonal to the conveyance direction of the conveyance path 1 so as not to interfere with each other, and plural bearings 4*b* are fixed at predetermined intervals to the paired right and left endless flexible members 4. Further, plural supports shafts 4*b* are carried horizontally for free rotation on the right and left bearings 4*b*', 4*b*', and the lower end portions of the pusher plates 2 are secured to the support shafts 4*b* so as to be pivotable in the direction opposite to the conveyance direction from its stand-up state.

Likewise, plural bearings 5*c* are fixed at predetermined intervals to the paired right and left endless flexible member 5, and plural support shafts 5*c* are carried for free rotation on the right and left bearings 5*c*', 5*c*'. Further, the lower end portions of the holding plates 3 are secured to the support shafts 5*c* so as to be pivotable in the same direction as the conveyance direction from its stand-up state.

With an intermittent operation of the drive source, the lower end portions of the pusher plates 2 and the holding plates 3 pass through a through hole la formed in the conveyance path 1 and move while maintaining the preset spacing between adjacent pusher plate 2 and holding plate 3 which are opposed to each other.

Pivotable faces 2*a* of the pusher plates 2 respectively opposed to the rear end faces B1 in the feed direction of the box-like contents are formed in a size and shape which permit the pivotable faces to come into partial abutment with and surely push all the rear faces B1 of the box-like contents irrespective of the change in size of the contents. Resilient members 4*c*, e.g. coiled springs, are mounted on the support shafts 4*b* with the lower end portions of the pusher plates 2 fixed thereto up to the bearings 4*b*' to bias the pivotable faces 2*a* so that the pivotable faces each fall down normally in a direction away from the rear faces B1 of the box-like contents B, namely in the direction opposite to the conveyance direction, at the time when the associated pusher stands by at the upstream end in the conveyance direction of the conveyance path 1. To each support shaft 4*b* is connected a follower 4*d* such as, for example, a driven roller through a swing lever 4*d*' engaged with a translation cam 4*e* and a fixed cam 4*f* both to be described below.

The translation cam 4*e* is supported in a position just under the upstream end in the conveyance direction of the conveyance path 1 so as to be reciprocate in the conveyance direction and so as to come into engagement with the follower 4*d* connected to the pusher plate 2 which is standing by at the upstream end of the conveyance path 1. Under intermittent operation control made through a cam or the like by the same drive source as that of the framing piece A' and pusher B', the translation cam 4*e* is moved in the same direction as the conveyance direction into engagement with the follower 4*d* when the operation of the endless flexible members 4 and 5 is off intermittently, whereby the pivotable face 2*a* of the pusher plate 2 present on the most upstream side falls down nearly horizontally in the direction opposite to the conveyance direction and assumes about the same height as the conveyance path. After the end of operation of a fold-down piece 7 to be described later, the translation cam 4*e* is moved in the direction opposite to the conveyance direction to let the follower 4*d* move pivotally, so that the pivotable face 2*a* of the pusher plate 2 located on the most upstream side moves pivotally up to the position of close contact with the rear face B1 in the conveyance direction of the box-like contents B which have been fed and is thereafter held in its stand-up state.

The fixed cam 4*f* is disposed to engage the followers 4*d* of all the pusher plates 2 continuously on the downstream side in the conveyance direction of the translation cam 4*e* and along the conveyance path 1, whereby irrespective of the intermittent operation of the endless flexible member 4 the pivotable faces 2*a* of the pusher plates 2 are each held in their stand-up state in abutment with the associated carton A and rear face B1 of the box-like contents B therein. Its downstream end is formed so that each pusher plate 2 which has moved to the downstream end of the conveyance path 1 sinks under the conveyance path without being caught on the carton A and box-like contents B after cartoning.

The followers 4*d* are guided so that the biasing force induced by the resilient members 4*c* may not be released during the period from when the pusher plates 2 sink under the conveyance path 1 until when they each return to the conveyance start position on the upstream side.

A pivotable face 3*a* of each holding plate 3, which face is opposed to the front face B2 in the conveyance direction of the box-like contents B, is formed smaller than at least the transverse width of each pusher plate 2, and a resilient member, e.g. coiled spring, is mounted from each support shaft 5*c* to which the lower end portion of the holding plate 3 is fixed up to the associated bearing 5*c*' to bias the pivotable face 3*a* so that the pivotable face 3*a* normally falls down in a direction away from the front face B2 of the box-like contents B, that is, in the direction opposite to the conveyance direction at the time when the holding plate 3 sinks under the conveyance path 1. To the support shaft 5*c* is connected a follower 5*e* such as a driven roller through, say, a swing lever 5*e*' which engages a fixed cam 5*f* to be described later.

The fixed cam 5*f* is disposed so as to engage the followers 5*e* of all the holding plates 3 along the conveyance path 1, whereby irrespective of the intermittent operation of the endless flexible member 5 the pivotable faces 3*a* of the holding plates 3 are held in their stand-up state in abutment with the cartons A and front faces B2 of the box-like contents B which are being conveyed. Its downstream end in the conveyance direction is formed so that when the conveyance reaches a position near the downstream end of the conveyance path 1, more particularly, a position upstream of the position where each pusher plate 2 sinks under the conveyance path, the associated holding plate 3 falls down away from the carton A and the front face B2 of the box-like contents after the end of cartoning and at the same time sinks through an opening lb formed in the conveyance path 1.

The followers 5*e* are guided so that the biasing force of the resilient members 5*d* may not be released during the period from when the holding plates 3 each sink under the conveyance path 1 and return to the conveyance start position on the upstream side.

Above the upstream end of the conveyance path 1 is disposed a fold-down piece 7 in opposition to an upper body flap A2 of the carton A which has been fed by the pusher B'. The fold-down piece 7 is supported so as to be vertically reciprocatably along the rear face B1 of the box-like contents B which have been fed. It is connected to the same drive source as that of the framing piece A', pusher B' and translation cam 4*e* and the operation thereof is thereby controlled intermittently through a cam or the like. Except just after operation of the pusher B', the fold-down piece 7 is allowed to stand by in its upper-limit position not interfering with the carbon A and box-like contents B that are fed by the pusher B'. Then, just after the end of operation of the pusher B' the fold-down piece 7 is moved down until its lower end reaches an approximately middle position in the vertical direction of the rear face B1 of the box-like contents B without interference with the return motion of the pusher, and either before or simultaneously with the start of movement of the translation cam 4*e* in the direction opposite to the conveyance direction, the fold-down piece 7 is moved upward to its stand-by position.

On the other hand, sideways in right and left positions of the conveyance path 1 are disposed fold-in pieces 8, 8 for folding inside side flaps A3, A3 of the carton A being conveyed.

In this embodiment, as shown in FIGS. 1 and 2, the fold-in pieces 8, 8 comprise fold-in tuckers 8*a*, 8*a* for folding in rear side flaps A4, A4 of the carton A along right and left side faces B3, B3 of box-like contents B of arranged and stacked packages. The fold in tuckers are disposed in positions downstream of the fold-down piece 7 and opposed to the rear side flaps A4, A4 of the carton A which has been fed. Fixed guides 8*b*, 8*b* are provided for folding in front side flaps A5, A5 of the carton A along the right and left side faces B3, B3 of the box-like contents B, the fixed guides 8*b*, 8*b* being disposed in positions downstream of the fold-in tuckers 8*a*, 8*a* and opposed to the front side flaps A5, A5 of the carton A which has been fed. Fold-up tuckers 8*c*, 8*c* fold up lower side flaps A6, A6 of the carton A along the right and left side faces B3, B3 of the box-like contents B. The fold-up tuckers 8*c*, 8*b* are disposed in positions downstream of the fixed guides 8*b*, 8*b* and opposed to the lower side flaps A6, A6 of the carton A which is in a standstill state.

The fold-in tuckers 8*a*, 8*a* and the fold-up tuckers 8*c*, 8*c* are connected to the same drive source as that of the framing piece A', pusher B', translation cam 4*e* and fold-down piece 7 and the operation thereof is controlled intermittently through a cam or the like. After the end of operation of the translation cam 4*e*, the fold-in tuckers 8*a*, 8*a* are moved in the fold-in direction, while the fold-up tuckers 8*c*, 8*c* are moved in the fold-up direction simultaneously with the operation of the fold-down piece 7 or of the translation cam 4*e* or simultaneously with the operation of the fold-in tuckers 8*a*, 8*a*.

As shown in FIG. 3, moreover, between the upstream end of the fixed guides 8*b*, 8*b* and the fold-up tuckers 8*c*, 8*c* is disposed an adhesive supply system 9 such as an adhesive shooting gun or the like for applying an adhesive, e.g. hot melt adhesive, to the outer surfaces of the folded front side flaps A5, A5 and rear side flaps A4, A4 being conveyed.

In a conveyance stop position intermediate the fixed cam 4*f* and downstream of the fold-up tuckers 8*c*, 8*c* is disposed a moving cam 4*g* vertically pivotably and in opposition to the follower 4*d* connected to each pusher plate 2, as shown in FIG. 1. A drive source 4*h*, e.g. air cylinder, adapted to operate upon detection of absence of the carbon A and box-like contents B is connected to the moving cam 4*g*. Only when an empty conveyance pocket C not loaded with carton A and box-like contents B for some reason or other has stopped in the position of the moving cam 4*g*, the moving cam is pivotally moved vertically. As a result, the pivotable face 2*a* of the pusher plate 2 moves pivotally by a predetermined angle in the direction opposite to the conveyance direction. At the same time, a supplementing mechanism 10 disposed above the empty conveyance pocket C is operated to let the box-like contents B in the carton A fall into the empty conveyance pocket.

The operation of the cartoning machine constructed as above will be described below.

First, upon operation of the pusher B' the box-like contents B of arranged and stacked packages strike against the carton A whose body portion has been folded in a generally U shape by the framing piece A', as shown in FIG. 1, whereby the carton A is wound in U shape around the box-like contents. In this state the box-like contents B, together with the carton A, are pushed toward the conveyance pocket C which is standing by on the most upstream side in the conveyance direction. By this time the pusher plate 2 of the conveyance pocket C on the most upstream side stands by in a substantially horizontally fallen state in the direction opposite to the conveyance direction. Passing over the pivotable face 2*a* of the fallen pusher plate 2, the U-wound carton A and the box-like contents B are fed into the conveyance pocket C located on the most upstream side, and the carton A and the front face B2 of the box-like contents B come into abutment with the holding plate 3 of the conveyance pocket C which plate is held in its stand-up state.

Thereafter, the fold-down piece 7 moves down to fold down the upper body flap A2, and then by operation of the translation cam 4*e* the pivotable face 2*a* of the fallen pusher plate 2 is raised to fold up the lower body flap A1 of the carton, which flap A1 is brought into overlap on the outside of the upper body flap A2. Now, the body folding of the carton A is over.

Further, upon feed of the carton and the box-like contents into the conveyance pocket C on the most upstream side, the front side flaps A5, A5 strike against the fixed guides 8*b*, 8*b* of the fold-in pieces 8, 8 and are folded in along the right and left side faces B3, B3 of the box-like contents B, and after the body folding of the carton A has been completed, the fold-in tuckers 8*a*, 8*a* strike against the rear side flaps A4, A4 and are folded in along the right and left side faces B3, B3 of the box-like contents B.

In this state, the endless flexible members 4 and 5 start moving to convey the carton A and box-like contents B in the conveyance pocket C on the most upstream side while holding them between the pusher plate 2 and the holding plate 3. An adhesive is applied from the adhesive supply means 9 to the outer surfaces of the folded front side flaps A5, A5 and rear side flaps A4, A4 being conveyed. When the movement of the carton A and the box-like contents B has stopped after completion of a single conveyance, the fold-up tuckers 8*c*, 8*c* strike against the lower side flaps A6, A6 to fold them up along the right and left side faces B3, B3 of the box-like contents B. Now, the folding of the side flaps A3, A3 is over and so is the cartoning of the box-like contents B.

With subsequent conveyance, the conveyance pocket C passes the position just under the supplementing mechanism 10. In this case, if there is a carton packed with box-like contents B within the conveyance pocket C, the moving cam 4*g* does not operate, but in the case where such packed carton is not present within the conveyance pocket for some reason or other, the moving cam 4*g* operates to open the pusher plate 2 and a carton A packed with box-like contents B is dropped into the pocket C from the supplementing mechanism 10.

In this way all the conveyance pockets C respectively convey cartons A packed with box-like contents B. When each packed carton arrives at a position near the downstream end of the conveyance path 1, the associated holding plate 3 sinks through the opening 1*b* formed in the conveyance path 1 and subsequently each packed carton passes over the opening 1*b* and is surely conveyed up to the downstream end of the conveyance path 1. After the packed carton is delivered to the subsequent step, the associated pusher plate 2 also sinks under the conveyance path, followed by repetition of the above operations.

When the external dimensions of box-like contents B have changed with a change in size of arranged and stacked packages, either the endless flexible member 4 or the endless flexible member 5 is moved for adjustment with respect to the other by the adjusting means 6 in accordance with the changed width in the feed direction, whereby the spacing between the pusher plate 2 and the holding plate 3 in each conveyance pocket C is adjusted and this adjustment is made for all of the conveyance pockets at a time. Thus, there is no need of performing the adjusting work for each of the conveyance packet C.

Further, the fold-in pieces 8, 8 for folding in the side flaps A3, A3 of each carton A being conveyed and the adhesive supply means 9 are moved for adjustment in accordance with the length in the transverse direction.

Although in the above embodiment each box-like contents B of arranged and stacked packages are abutted against each carton A whose body portion has been folded in a generally U shape by the framing piece A', this constitutes no limitation. Rather it goes without saying that the box-like contents B may be abutted against a flat carton A prior to folding without the provision of the faming piece A'.

Also as to the shape of carton A, although the carton A used in the above embodiment is provided, as side flaps A3, A3, with rear side flaps A4, A4, front side flaps A5, A5 and lower side flaps A6, A6, this constitutes no limitation, but there may be used a carton A having upper side flaps in addition to those side flaps. In this case, an additional means is provided for folding down the upper side flaps.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

I claim:

1. A cartoning machine wherein generally rectangular contents of arranged and stacked packages are fed in a feed direction and abutted against a foldable flat carton, the flat carton being fed in a direction substantially orthogonal to the feed direction of the contents, thereby allowing the carton to be folded in U shape around the contents, then while the contents and the carton are conveyed substantially horizontally in the feed direction, body flaps and side flaps of the carton are folded in successively to pack the contents into the folded carton, said cartoning machine comprising:

a plurality of conveyance pockets arranged in a conveyance direction of the contents each conveyance pocket engaging with a fed carton and contents to convey the carton and contents along the conveyance direction;

endless flexible members, said plurality of conveyance pockets positioned along said endless flexible members, at predetermined intervals;

a drive source connected to said endless flexible members to move said endless flexible members intermittently;

one pivotable face supported pivotably in each of said plurality of conveyance pockets and opposingly abuttable with a lower body flap of the carton and with a rear face, in the feed direction, of the contents;

means for depressing and holding said one pivotable face of the conveyance pocket, positioned on the most upstream side in the conveyance direction, in the direction opposite to the feed direction so that said pivotable face becomes substantially flush with an inner bottom surface of the conveyance pocket until the fed carton and contents transfer into the conveyance pocket;

a fold-down piece that folds down an upper body flap of the carton along the rear face of the contents when the fed carton and contents have passed into the conveyance pocket positioned at the most upstream side in the conveyance direction;

raising means for pivotally raising the one pivotable face after operation of the fold-down piece;

raised state holding means for holding the one pivotable face in a raised state; and a fold-in piece that successively folds the side flaps of the cartons as the cartons are conveyed simultaneously in said plurality of conveyance pockets by the operation of the endless flexible members.

2. A cartoning machine according to claim 1, further comprising:

another face supported pivotably in each of the plurality of conveyance pockets and opposingly abuttable with each carton and a front face, in the feed direction, of the associated contents; and means for moving said another face away from the front face of the contents when the carton and contents are conveyed to a downstream position with respect to the fold-in piece, whereby each carton and contents are discharged after completion of cartoning.

3. A cartoning machine according to claim 1, wherein said plurality of conveyance pockets each comprise a conveyance path provided along an extension of the feed direction of the contents, each carton and contents being moved along said conveyance path, a pivotable pusher plate opposingly abuttable with both a lower body flap of the carton and the rear face, in the feed direction, of the contents, and a hold plate that is opposingly abuttable with the carton and the front face, in the feed direction, of the contents to hold the carton and the contents between the holding plate and the pusher plate.

4. A cartoning machine according to claim 2, wherein said plurality of conveyance pockets each comprise a conveyance path provided along an extension of the feed direction of the contents, each carton and contents being moved along said conveyance path, a pivotable pusher plate opposingly abuttable with both a lower body flap of the carton and the rear face, in the feed direction, of the contents, and a holding plate opposingly abuttable with the carton and the front face, in the feed direction, of the contents to hold the carton and the contents.

5. A cartoning machine according to claim 1, further comprising adjusting means for supporting one face of the plurality of conveyance pockets opposed to one of the front face and rear face side of the carton and contents so that said supported face is movable for adjustment relative to the other face, whereby all of the conveyance pockets are adjusted at one time.

6. A cartoning machine according to claim 1, further comprising adjusting means for supporting one face of the plurality of conveyance pockets opposed to one of the front face and rear face side of the carton and contents so that said supported face is movable for adjustment relative to the other face, whereby all of the conveyance pockets are adjusted at one time.

7. A cartoning machine according to claim 1, further comprising adjusting means for supporting one face of the plurality of conveyance pockets opposed to one of the front face and rear face side of the carton and contents so that said supported face is movable for adjustment relative to the other face, whereby all of the conveyance pockets are adjusted at one time.

8. A cartoning machine according to claim 5, wherein said adjustment means adjusts a positional relation between the endless flexible member connected to pusher plates of each of said conveyance pockets and the endless flexible member connected to holding plates of each of said conveyance pockets.

9. A cartoning machine according to claim 6, wherein said adjusting means adjusts a positional relation between the endless flexible member connected to the pusher plates and the endless flexible member connected to the holding plates.

10. A cartoning machine according to claim 7, wherein said adjusting means adjusts a positional relation between the endless flexible member connected to the pusher plates and the endless flexible member connected to the holding plates.

11. A cartoning machine according to claim 1, wherein said fold-in piece comprises:

fold-in tuckers disposed on a downstream side, in the conveyance direction, with respect to the fold-down piece, said tuckers folding rear side flaps of each carton along right and left side faces of the associated contents;

fixed guides that fold front side flaps along the right and left side faces of the contents; and fold-up tuckers that fold lower side flaps along the right and left side faces of the contents.

12. A cartoning machine according to claim 2, wherein said fold-in piece comprises:

fold-in tuckers disposed on a downstream side, in the conveyance direction of the fold-down piece, said tuckers folding rear side flaps of each carton along right and left side faces of the associated contents;

fixed guides that fold front side flaps along the right and left side faces of the contents; and fold-up tuckers that fold lower side flaps along the right and left side faces of the contents.

13. A cartoning method wherein generally rectangular, arranged and stacked contents are fed horizontally into abutment with a flat foldable carton, the carton fed in a direction substantially orthogonal to the feed direction of the contents, thereby allowing a body portion of the carton to form a U shape around the contents, and body flaps and side flaps of the carton are folded in successively while the contents and the carton are conveyed substantially horizontally to pack the contents into the folded carton, said method comprising:

depressing and holding one pivotable face of a conveyance pocket in the direction opposite to the feed direction of the contents so as to be substantially flush with an inner bottom surface of the conveyance pocket until the fed carton and contents transfer into the conveyance pocket, the pivotable face being opposingly abuttable with a lower body flap of the carton and a rear face, in the feed direction, of the contents, the conveyance pocket being disposed in the feed direction of the contents and positioned on the most upstream side in the conveyance direction;

folding down an upper body flap of the carton along the rear face of the contents by a fold-down piece when the fed carton and contents have passed into the conveyance pocket on the most upstream side in the conveyance direction;

pivotally raising the pivotable face after the folding down by the fold-down piece;

moving a plurality of contents and cartons within a plurality of conveyance pockets simultaneously, by the operation of endless flexible members to which the plurality of conveyance pockets are attached; and folding in side flaps of the cartons successively during the movement by a fold-in piece.

14. A cartoning method according to claim 13, further comprising depressing another pivotable face provided in each of the conveyance pockets spaced from a front face in the feed direction and being opposingly abuttable with the front face side of each carton and contents, to carry each carton and contents after cartoning, out of the associated conveyance pocket, when the carton and the contents have been conveyed to a downstream side with respect to the fold-in piece.

* * * * *